US006339400B1

(12) United States Patent
Flint et al.

(10) Patent No.: US 6,339,400 B1
(45) Date of Patent: Jan. 15, 2002

(54) INTEGRATED ANTENNA FOR LAPTOP APPLICATIONS

(75) Inventors: Ephraim Bemis Flint, Garrison, NY (US); Brian Paul Gaucher, New Milford, CT (US); Duixian Liu, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/598,719

(22) Filed: Jun. 21, 2000

(51) Int. Cl.[7] ..... H01Q 13/10
(52) U.S. Cl. ..... 343/702; 343/767
(58) Field of Search ..... 343/702, 725, 343/767, 700 MS, 834, 845, 846; 455/90

(56) References Cited

U.S. PATENT DOCUMENTS

| | | | | |
|---|---|---|---|---|
| 4,131,892 A | | 12/1978 | Munson et al. | 343/700 MS |
| 4,131,893 A | | 12/1978 | Munson et al. | 343/700 MS |
| 4,367,475 A | | 1/1983 | Schiavone | 343/767 |
| 5,677,698 A | * | 10/1997 | Snowdon | 343/770 |
| 5,966,098 A | * | 10/1999 | Qi et al. | 343/702 |
| 6,184,833 B1 | * | 2/2001 | Tran | 343/700 MS |

OTHER PUBLICATIONS

David Pogue, The iBook: What Steve Jobs Didn't Say, in MacWorld on the web, pp. 1–3, Jul. 18, 1999.
Anonymous, Apple PowerBook G3 500 MHz Full Review, in PC Magazine on the web, pp. 1–2, date unknown.
Wendy J. Mattson, Fast PowerBooks Start to Arrive, in MacWeek.com, pp. 1–2, Jun. 7, 1999.
Andy (last name unknown), The Vision Thing: No Strings Attached, in MacWorld on the web, pp. 1–3, Jul. 18, 1999.
Anonymous, Apple Introduces AirPort Wireless Networking, in CreativePro.com on the web, pp. 1–2, Jul. 21, 1999.
Anonymous, Apple PowerBook G4 Technical Specifications, pp. 1–4, 2001.
Anonymous, PowerBook G4, pp. 1–4, Jan. 2001.
Color Photograph of Apple® PowerBook® computer showing first antenna on top left of display and second antenna on middle of right display frame, reflecting product as available on or about Jul. 26, 2000, date of product introduction unknown.
Color Photograph of Apple® PowerBook® computer showing enlarged view of antenna on top left of display, reflecting product as available on or about Jul. 26, 2000, date of product introduction unknown.
Color Photograph of Apple® PowerBook® computer showing enlarged view of antenna on middle of right display frame, reflecting product as available on or about Jul. 26, 2000, date of product introduction unknown.

* cited by examiner

*Primary Examiner*—Don Wong
*Assistant Examiner*—James Clinger
(74) *Attorney, Agent, or Firm*—F. Chau & Associates, LLP

(57) ABSTRACT

An antenna for integration into a portable computing device is provided. The computer includes a display mounted on a metal frame. The antenna includes a radiating element extending from the metal frame, and a conductor comprising a first component for conducting a signal and a second component connected to the metal frame for grounding the antenna.

16 Claims, 8 Drawing Sheets

HE: 0.6 dBi
VE: -0.5 dBi
TE: 2.1 dBi

INTEGRATED ANTENNA FOR LAPTOP APPLICATIONS

BACKGROUND OF THE INVENTION

1. Field of the Invention

The present invention relates to antennas, more particularly to integrated antennas for portable computers.

2. Description of the Related Art

Typically, a wired cable is used by a laptop to communicate with another processing device such as another laptop, desktop, server, or printer. To communicate without a wired connection, an antenna is needed. FIG. 1 shows a laptop with external antennas. Antenna 10 is located at the top of a laptop display for better RF clearance, or just outside (dash line for antenna) of a PCMCIA card 11. Usually, optimum wireless performance is achieved if the antenna is mounted on the top of the display 10. As compared to internal antennas, external antennas are generally more expensive and are more susceptible to damage.

An internal or embedded antenna generally will not perform as well as an external antenna. The commonly used method to improve the performance of an embedded antenna is to keep the antenna away from any metal component of the laptop. Depending on the design of the laptop and the type of antenna, the distance between the antenna and metal components should be at least 10 mm. FIG. 2 shows prior art embedded antenna implementations in which two antennas are typically used. Two whip-like/slot embedded antennas are placed on the left 20 and right 21 edge of the display. Using two antennas instead of one antenna will reduce the blockage caused by the display in some directions and provide space diversity to the communication system. As a result, the size of the laptop becomes larger to accommodate antenna placement. In another configuration, one antenna can be placed on one side (20 or 21) of the display and a second antenna on the top 22 of the display. This latter antenna configuration may also provide antenna polarization diversity depending on the antenna design used.

As wireless communications among processing devices become increasingly popular, a need exists for a compact integrated antenna having reduced costs and enhanced performance.

SUMMARY OF THE INVENTION

An antenna for integration into a portable processing device having a display is provided. According to an aspect of the present invention, the antenna comprises: a metal frame embedded in a housing of the display; a radiating element extending from the housing; and a conductor having a first component for carrying a signal to the processing device and a second component for connecting to the metal frame for grounding the radiating element. The conductor is preferably a coaxial cable having an inner feed conductor connected to the radiating element and an outer conductor connected to the metal frame.

The radiating element may be one of an inverted-F antenna and a slot antenna.

The antenna according to an illustrative embodiment further includes a feed conductor for impedance match, the feed conductor being disposed at about midpoint of the length of the antenna arrangement. The radiating element may be disposed substantially along a x-y plane of the display, or disposed substantially transversely to the x-y plane of the display.

According to another aspect of the invention is an antenna arrangement comprising: a conductive RF shielding foil disposed on the back of an electronic display the foil having an opening; and a slot antenna having a feed portion extending partially through the opening of the foil. Preferably, the antenna arrangement further comprises a conductor comprising a first component for conducting the signal connected to the feed portion and a second component for grounding the conductor connected to the RF foil opposite the feed portion.

An integrated antenna arrangement according to another embodiment of the present invention comprises: a conductive RF shielding foil disposed on the back of an electronic display having a notch; and a feed portion extending partially across the notch forming an inverted-F antenna. The antenna further comprising means for conducting a signal comprising a first component for conducting the signal connected to the feed portion and a second component for grounding the conducting means connected to the RF foil opposite the feed portion. The means for conducting the signal is preferably a coaxial cable having an inner conductor connected to the feed portion and an outer conductor connected to the RF foil opposite the feed portion.

An antenna according to still another embodiment of the present invention is integrated in a portable computer having a display, comprising: a metal support embedded in a housing for supporting the display; a radiating element extending from the metal support; a first conductor for carrying a signal from a first portion of the radiating element to the computer; and a second conductor for connecting a second portion of the radiating element to the metal support for grounding the radiating element.

BRIEF DESCRIPTION OF THE DRAWINGS referred embodiments of the present invention will be described below in more detail with reference to the accompanying drawings.

DETAILED DESCRIPTION OF PREFERRED EMBODIMENTS

According to the present invention, embedded antennas are disposed on either edge of a laptop display, the metal rims that supports the display, or in the RF shielding foil (on the back) of the display. Many antenna types, such as chip antennas, slot antennas, inverted-F antennas and notch antennas, are applicable in this design. The advantages of this design include: smaller antenna size, inexpensive to manufacture, minimum effects on industrial design, and reliable performance.

Figure 1:
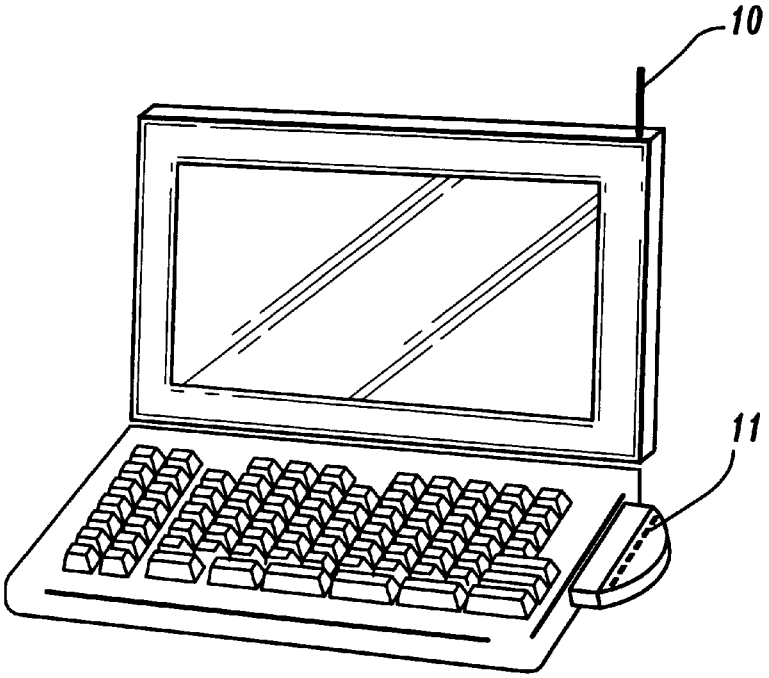
FIG. 1 (Prior Art)
FIG. 1 (prior art) illustrates two outside antennas.
Figure 2:
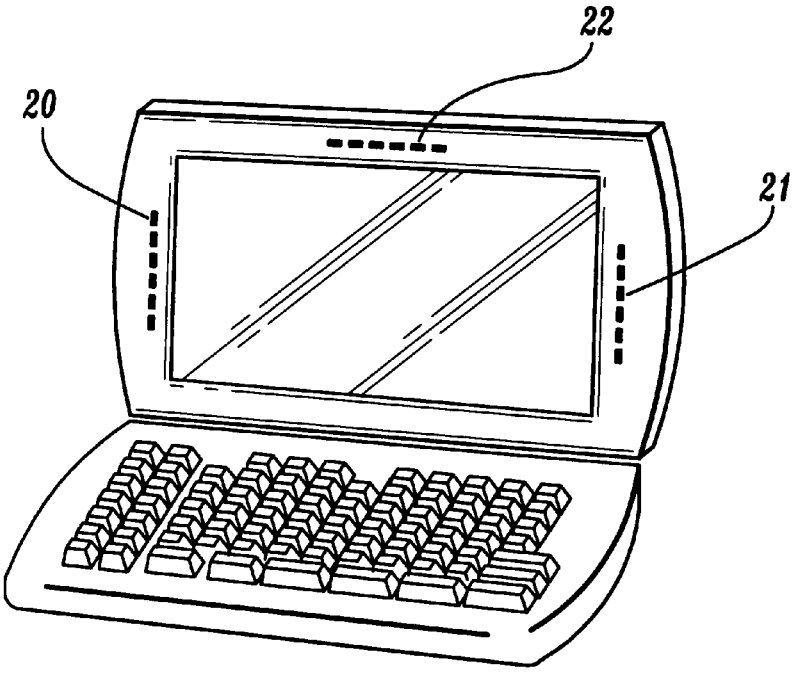
FIG. 2 (Prior Art)
FIG. 2 (prior art) illustrates whip-like/slot embedded antennas.
Figure 3:
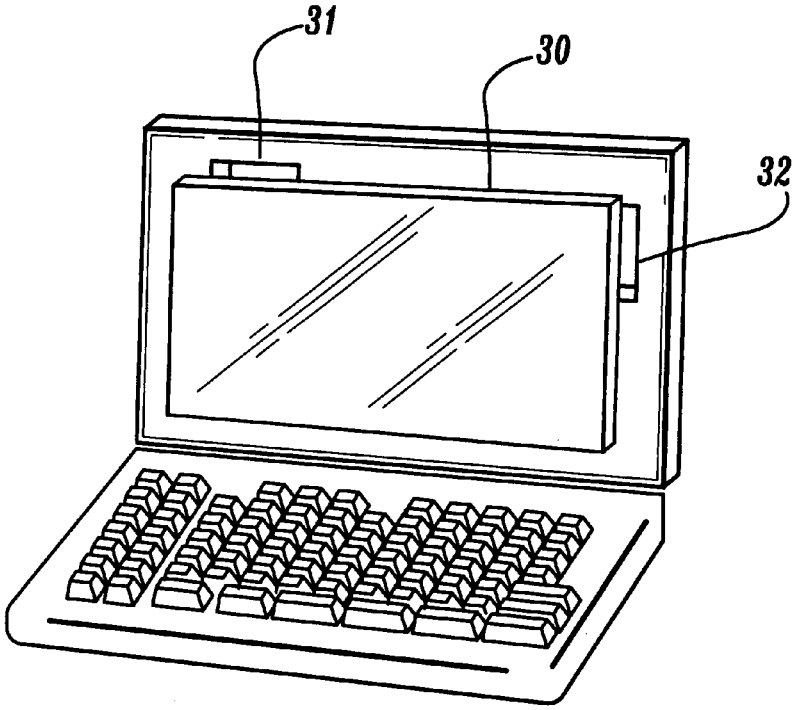
FIG. 3 illustrates slot antennas disposed in the plane of (parallel to) a laptop computer display according to one embodiment of the present invention.
Figure 4:
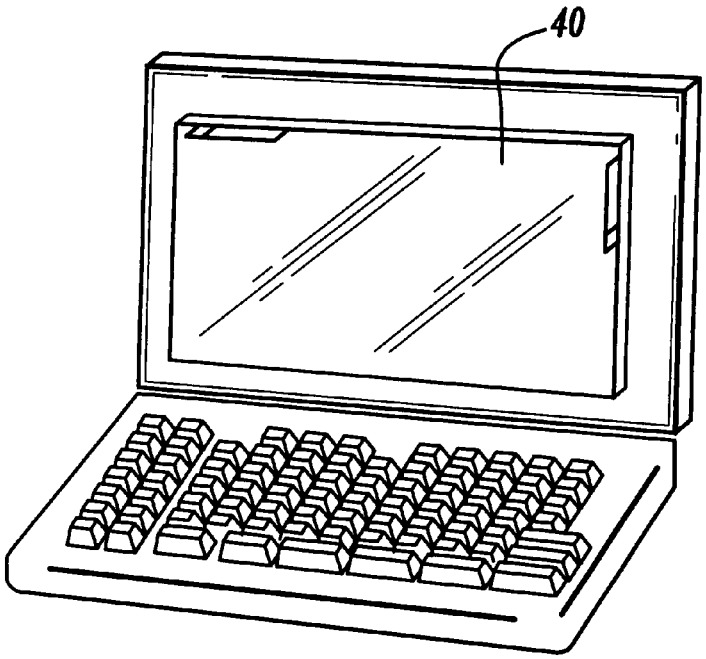
FIG. 4 illustrates slot antennas transversely disposed (in a z axis relative to the display substantially in the x and y axes) to the laptop display according to another embodiment of the present invention.
Figure 5:
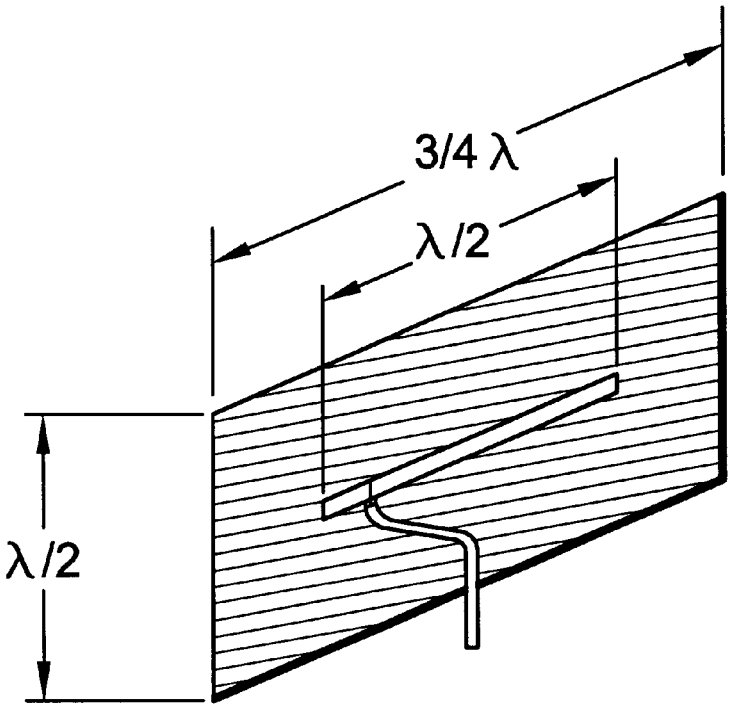
FIG. 5 (Prior Art)
FIG. 5 (prior art) illustrates a traditional slot antenna.
Figure 13:
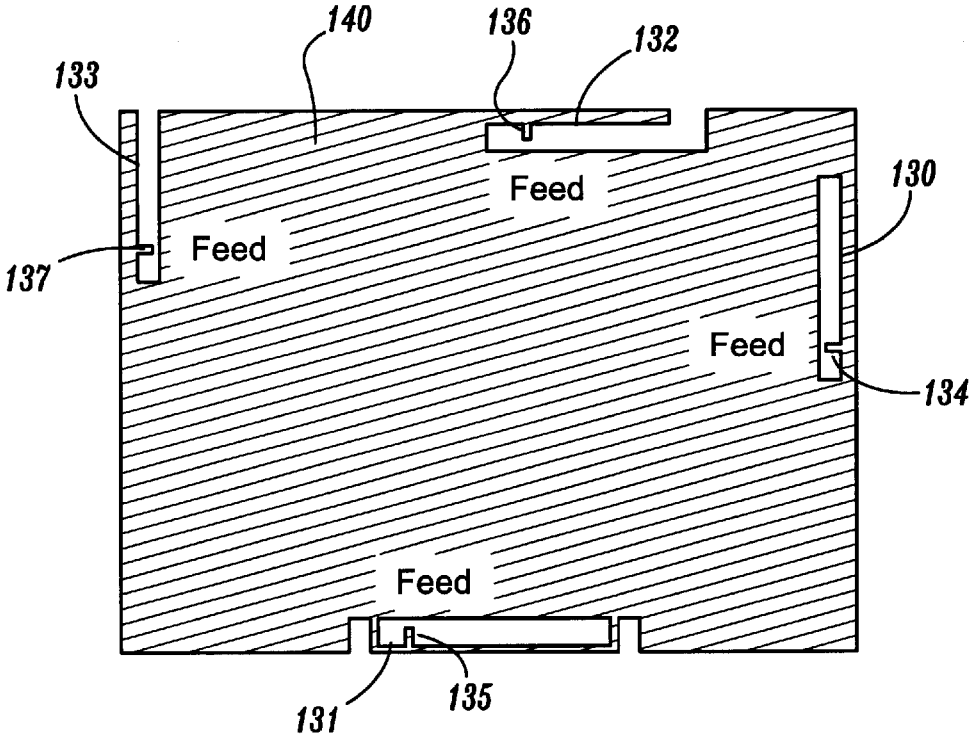
FIG. 13 illustrates various configurations for inverted-F and slot antennas built on an RF shielding foil.

Referring to FIGS. 3, 4, and 13 in one embodiment of the present invention, the display frame 30 supports an antenna 31–32, or the RF shielding foil 140 of FIG. 13 on the back of the display is part of the antenna. The slot antenna of the present invention is slightly different from a traditional slot that needs a large ground plane as shown in FIG. 5 where the slot is at the center of the metal ground plate. The slot antenna can be disposed parallel, along the x-y plane of the display, or perpendicular along a z axis relative to the x and y axes of the display, as shown in FIGS. 3 and 4 respectively. The two antenna orientations described have similar performances. One skilled in the art will recognize that other orientations, configurations and combinations thereof are possible, for example, an antenna oriented at an angle to the display, a system having a pair of antennas including one inverted-F antenna and one slot antenna, two antennas on both sides of display or a single antenna.

Figure 6:
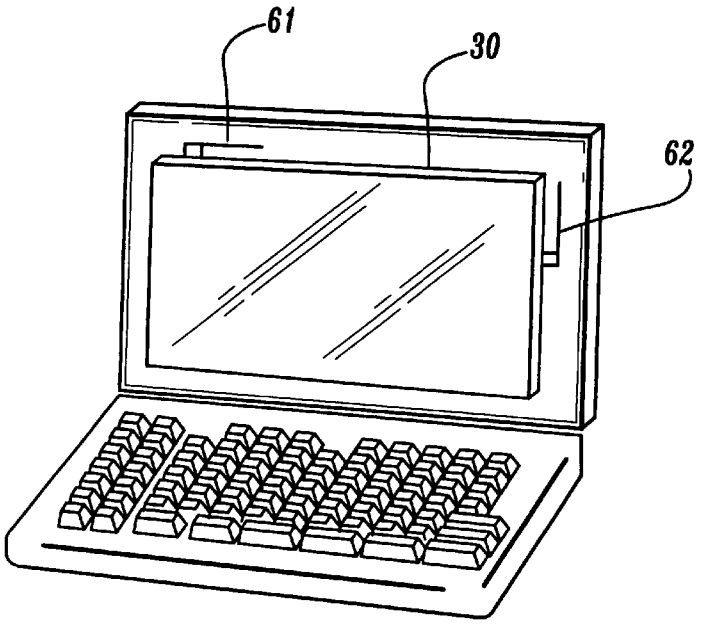
FIG. 6 illustrates inverted-F antennas disposed in the plane of the laptop display according to still another embodiment of the present invention.
Figure 7:
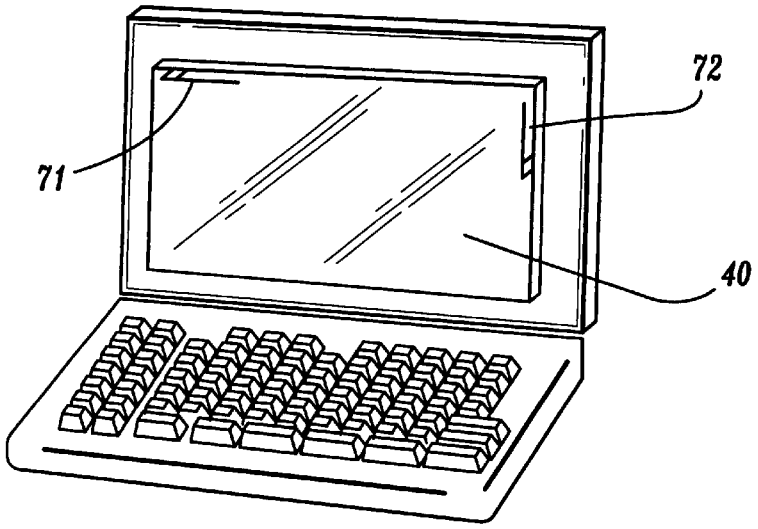
FIG. 7 illustrates inverted-F antennas transversely disposed to the laptop display according to another embodiment of the present invention.
Figure 8:
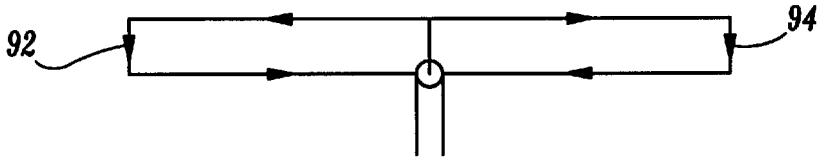
FIG. 8 (Prior Art)
FIG. 8 (prior art) illustrates a known slot antenna without a ground plate.

If space is limited, an inverted-F antenna (61–62 & 71–72) might be used as shown in FIGS. 6 and 7. The inverted-F antenna has about half length of the slot antenna. The inverted-F antenna has wide SWR bandwidth, but the gain value is usually lower than that of the slot antenna. So its wide SWR bandwidth is due to its lower efficiency. For a simple slot antenna shown in FIG. 8, the radiation primarily comes from the two short sides 92, 94 of the slot if the slot is very narrow. The two radiating sides 92, 94 form a two element array with half wavelength separation. The high gain (or efficiency) is due to the array factor. The inverted-F antenna has only one radiating element 98. For a slot antenna, impedance match is achieved by moving the feed line toward the center to increase impedance or toward the end to decrease impedance. Alternatively, fbr an inverted-F antenna, impedance match is achieved by moving the feed line toward the open end of the antenna to increase impedance or toward the closed end to decrease impedance.

Figure 3A:
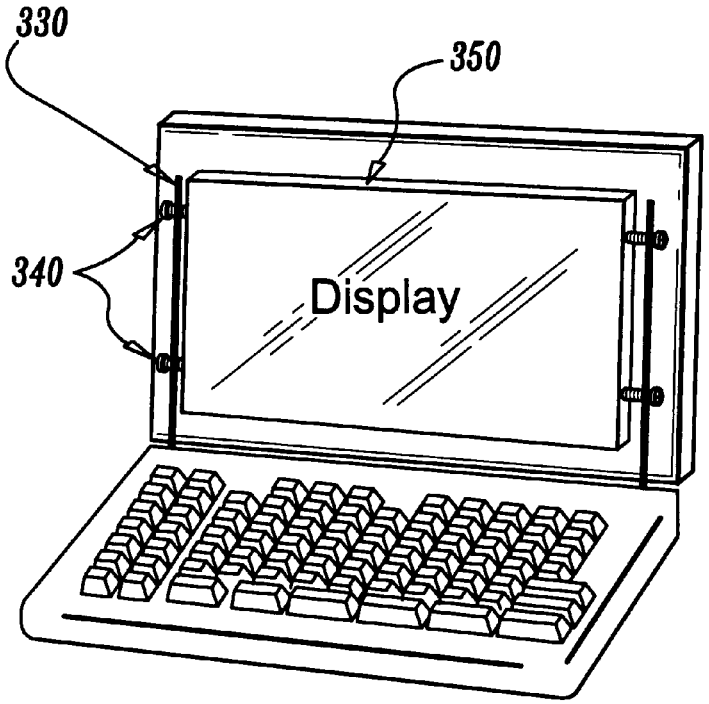
FIG. 3A illustrates a laptop display mounted on metal support of a display cover.
Figure 9:
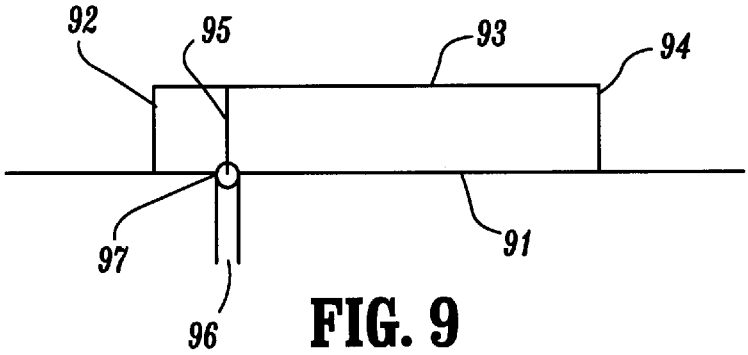
FIG. 9 illustrates a slot antenna according to an embodiment of the present invention.

Preferred embodiments of the present invention will be described below in more detail with reference to the accompanying drawings:

FIG. 9 shows the general configuration of a slot antenna according to the present invention. The component 91 represents the ground plane provide by the laptop display frame, some metal support structure or the RF shielding foil on the back of the display. Components 92, 93, and 94 can be made from a single thin wire, stamped from a metal sheet, or built into the metal support of the display. The component 95 can be the inner conductor of the coaxial cable 96. The outside metal shield 97 of the coaxial cable 96 is connected to the ground plane 91. FIG. 3A shows the interior of a laptop display which is mounted on metal support 330 via screws 340. The metal support includes embedded antenna, which electrically connects to the metal frame 350 of the display.

Figure 10:
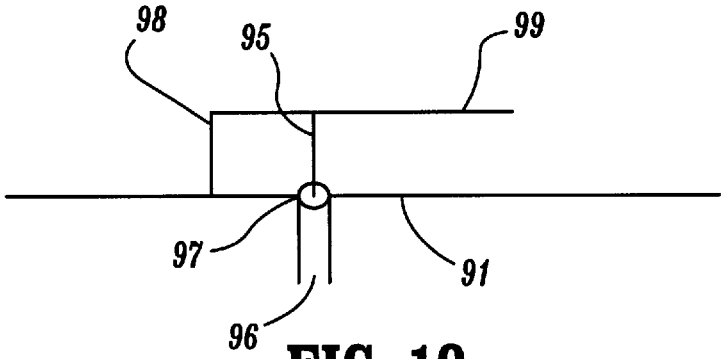
FIG. 10 illustrates a inverted-F antenna according to an embodiment of the present invention.

FIG. 10 shows the general configuration of the inverted-F antenna implemented in this invention. Components 98 and 99 are either made from a single thin wire or stamped from a metal sheet or built into the metal support of the display.

Figure 11:
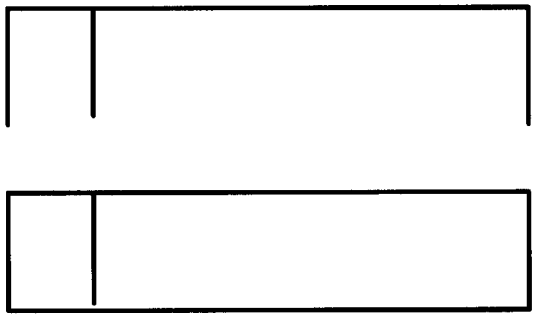
FIG. 11 illustrates various configurations for stamped/wire slot antennas according to an embodiment of the present invention.
Figure 12:
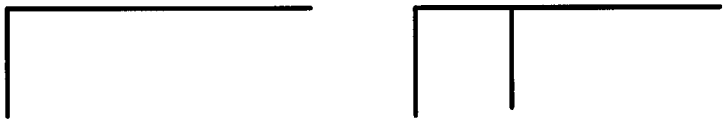
FIG. 12 illustrates various configurations for stamped/wire inverted-F antennas according to another embodiment of the present invention.

FIGS. 11 and 12 show possible antenna components for slot and inverted-F antennas, respectively.

FIG. 13 shows preferred slot 130, 131 and inverted-F 132, 133 antennas built on the RF shielding foil 140 on the back of the display. To ensure good efficiency for the antennas built into the RF shielding foil 140, the foil material should have good conductivity, for example, aluminum, copper, or brass. In an alternative embodiment of the present invention, either type of antennas has a feed portion 134 and 137 which is preferably connected to the conductive portion of the coaxial cable 95 (shown in FIGS. 9 and 10). The metal shield portion 97 of coaxial cable 96 is connected to the RF foil opposite to the feed portion (134 and 137).

In a preferred embodiment, the slots of the antennas are parallel to displays as shown in FIGS. 3 and 6. A single antenna is implemented on one edge of the display. These antennas are inside the laptop covers and have little effect on industrial designs.

Figure 14:
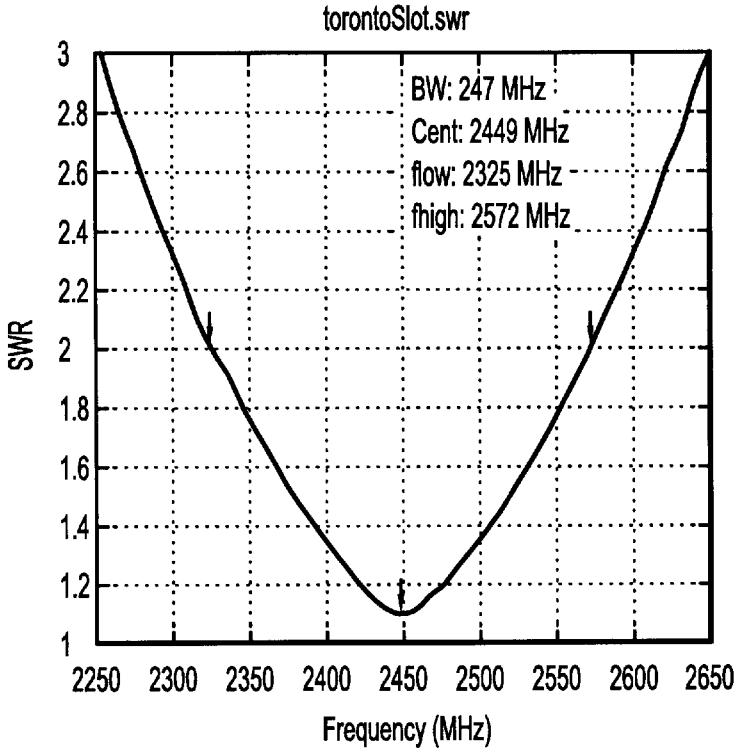
FIG. 14 is a graph of VSWR for a slot antenna according to the present invention.
Figure 15:
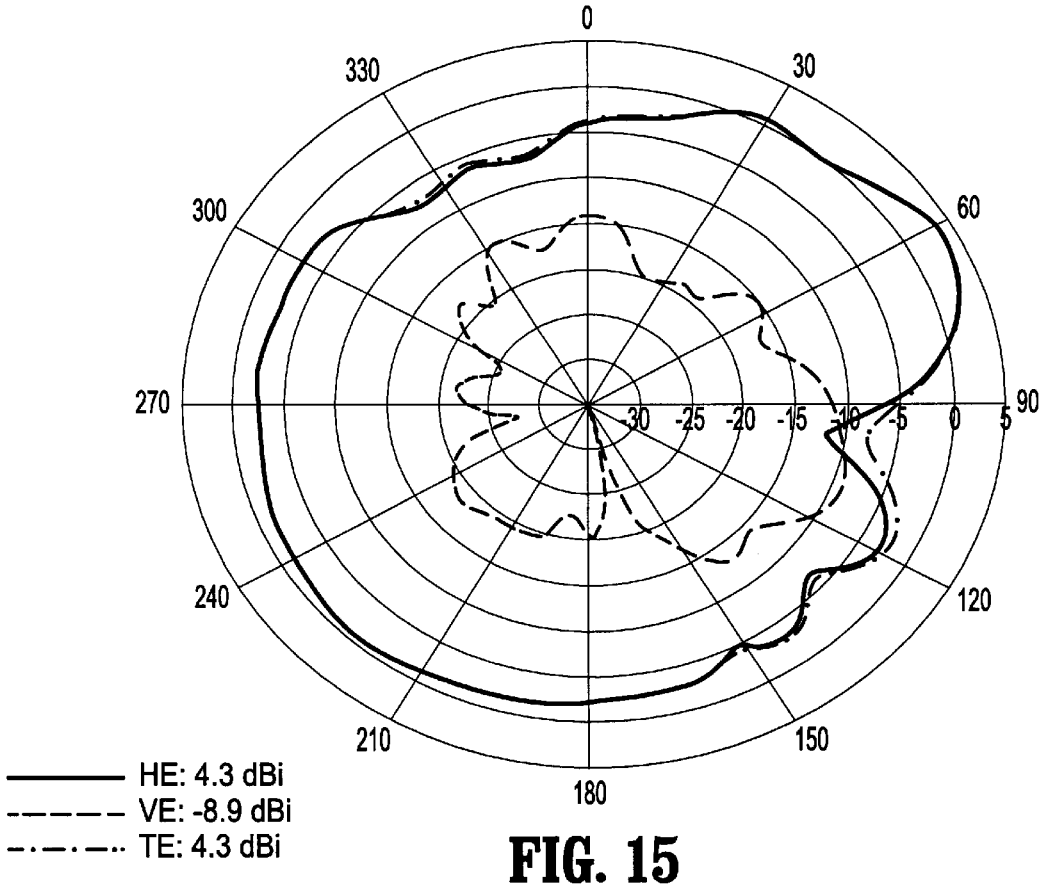
FIG. 15 is a graph of radiation patterns for a slot antenna according to the present invention.
Figure 16:
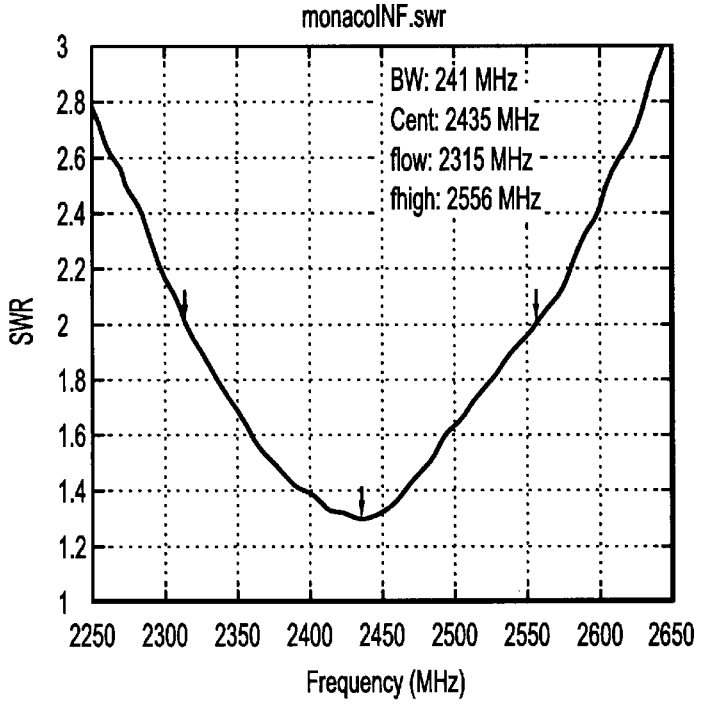
FIG. 16 is a graph of VSWR for an inverted-F antenna according to the present invention.
Figure 17:
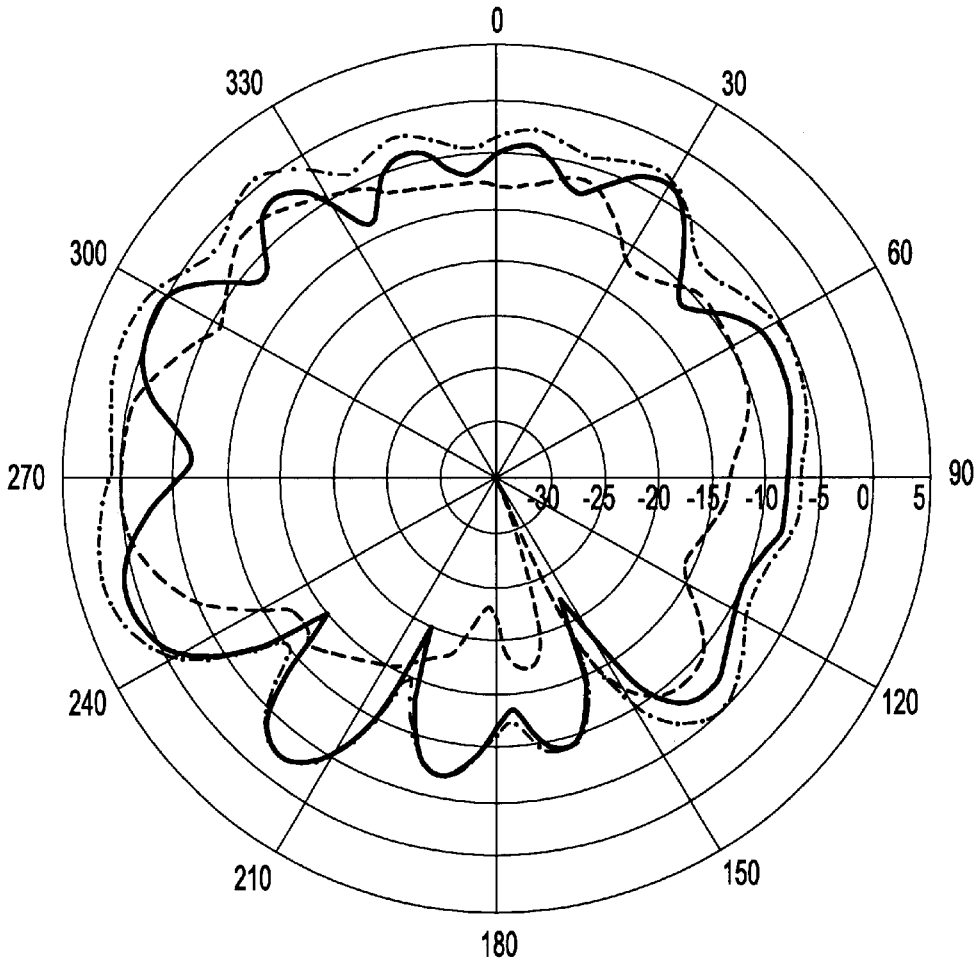
FIG. 17 is a graph of radiation patterns for a inverted-F antenna according to the present invention.

FIGS. 14 and 16 show the measured standing wave ratio (SWR) for slot and inverted-F antennas, respectively. The SWR is preferably wide enough for the 2.4 GHz ISM band which has about 100 MHz bandwidth. FIGS. 15 and 17 show a horizontal plane radiation patterns for individual slot and inverted-F antennas respectively. FIGS. 14 through 17 represent actual antenna performance measured using an IBM ThinkPad®. In the radiation patterns, HE, VE, and TE refer to the horizontal, vertical and total electrical fields respectively.

Having described preferred embodiments of an integrated antenna for laptop applications, it is noted that modifications and variations can be made by persons skilled in the art in light of the above teachings. It is therefore to be understood that changes may be made in the particular embodiments of the invention disclosed which are within the scope and spirit of the invention as defined by the appended claims.

What is claimed is:

1. An antenna for integration into a portable processing device having a display, the antenna comprising:

a metal frame embedded in a housing of the display;

a radiating element extending from the housing; and a conductor having a first component for carrying a signal to the processing device and a second component for connecting to the metal frame for grounding the radiating element.

2. The antenna of claim 1, wherein the radiating element is one of an inverted-F antenna and a slot antenna.

3. The antenna of claim 1, wherein the conductor is a coaxial cable having an inner feed conductor connected to the radiating element and an outer conductor connected to the metal frame.

4. The antenna of claim 2, further including a feed conductor for impedance match, the feed conductor being disposed at about midpoint of the length of the antenna arrangement.

5. The antenna of claim 1, wherein the radiating element is disposed substantially along a x-y plane of the display.

6. The antenna of claim 1, wherein the radiating element is disposed substantially transversely to the x-y plane of the display.

7. An antenna arrangement comprising:

a conductive RF shielding foil disposed on the back of an electronic display the foil having an opening; and a slot antenna having a feed portion extending partially through the opening of the foil.

8. The antenna arrangement of claim 7, further comprising a conductor comprising a first component for conducting the signal connected to the feed portion and a second component for grounding the conductor connected to the RF foil opposite the feed portion.

9. The antenna arrangement of claim 8, wherein the conductor is a coaxial cable having an inner conductor connected to the feed portion and an outer conductor connected to the RF foil opposite the feed portion.

10. The antenna arrangement of claim 7, wherein an impedance match is achieved by positioning a feed conductor at a midpoint of the length of the antenna arrangement for increasing impedance and towards an end of the length for decreasing the impedance.

11. An integrated antenna arrangement comprising:

a conductive RF shielding foil disposed on the back of an electronic display having a notch; and a feed portion extending partially across the notch forming an inverted-F antenna.

12. The antenna arrangement of claim 11, further comprising a means for conducting a signal comprising a first component for conducting the signal connected to the feed portion and a second component for grounding the conducting means connected to the RF foil opposite the feed portion.

13. The antenna arrangement of claim 11, wherein the means for conducting the signal is a coaxial cable having an inner conductor connected to the feed portion and an outer conductor connected to the RF foil opposite the feed portion.

14. The antenna arrangement of claim 11, wherein an impedance match is achieved by positioning a feed conductor at an open end of the length of the antenna arrangement for increasing impedance and towards a closed end of the length for decreasing the impedance.

15. An antenna for a portable computer having a display, comprising:

a metal support embedded in a housing for supporting the display;

a radiating element extending from the metal support;

a first conductor for carrying a signal from a first portion of the radiating element to the computer; and a second conductor for connecting a second portion of the radiating element to the metal support for grounding the radiating element.

16. The antenna of claim 15, wherein the radiating element is one of an inverted-F antenna and a slot antenna.

* * * * *